US011466847B2

(12) United States Patent
Hikmet et al.

(10) Patent No.: US 11,466,847 B2
(45) Date of Patent: Oct. 11, 2022

(54) LED FILAMENT ARRANGEMENT WITH HEAT SINK STRUCTURE

(71) Applicant: SIGNIFY HOLDING B.V., Eindhoven (NL)

(72) Inventors: Rifat Ata Mustafa Hikmet, Eindhoven (NL); Ties Van Bommel, Horst (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/288,743

(22) PCT Filed: Oct. 21, 2019

(86) PCT No.: PCT/EP2019/078518
§ 371 (c)(1),
(2) Date: Apr. 26, 2021

(87) PCT Pub. No.: WO2020/088966
PCT Pub. Date: May 7, 2020

(65) Prior Publication Data

US 2022/0120426 A1 Apr. 21, 2022

(30) Foreign Application Priority Data

Oct. 29, 2018 (EP) ..... 18203060

(51) Int. Cl.
*F21V 29/70* (2015.01)
*F21K 9/232* (2016.01)
*F21Y 115/10* (2016.01)

(52) U.S. Cl.
CPC ..... *F21V 29/70* (2015.01); *F21K 9/232* (2016.08); *F21Y 2115/10* (2016.08)

(58) Field of Classification Search
CPC ..... F21V 29/70; F21K 9/232
See application file for complete search history.

(56) References Cited

U.S. PATENT DOCUMENTS 8,534,880 B1 9/2013 Berg et al.
2005/0189557 A1 9/2005 Mazzochette et al.
(Continued)

FOREIGN PATENT DOCUMENTS

CN 203810164 U 9/2014
CN 207424459 U 5/2018
(Continued)

*Primary Examiner* — Karabi Guharay
(74) *Attorney, Agent, or Firm* — Daniel J. Piotrowski

(57) ABSTRACT

A light emitting diode, LED, filament arrangement (100), comprising at least one LED filament (120) extending along a longitudinal axis, A, wherein the at least one LED filament comprises an array of a plurality of light emitting diodes (140), LEDs, and an encapsulant (145) comprising a translucent material, wherein the encapsulant at least partially encloses the plurality of LEDs. The LED filament arrangement further comprises a heat sink structure (150), wherein the encapsulant of the least one LED filament is in thermal connection with the heat sink structure for a dissipation of heat from the at least one LED filament, and wherein the heat sink structure comprises a reflective surface (160) for reflecting the incident light from the at least one LED filament.

13 Claims, 4 Drawing Sheets

(56) References Cited

U.S. PATENT DOCUMENTS

| | | | | |
|---|---|---|---|---|
| 2016/0178133 | A1* | 6/2016 | Kong | F21K 9/232<br>362/382 |
| 2018/0031185 | A1 | 2/2018 | Pettmann | |
| 2018/0315899 | A1* | 11/2018 | Li | F21V 31/00 |

FOREIGN PATENT DOCUMENTS

| | | | | |
|---|---|---|---|---|
| EP | 2827046 | A1 | 1/2015 | |
| EP | 3276254 | A1 | 1/2018 | |
| WO | 2015103813 | A1 | 7/2015 | |
| WO | 2017028787 | A1 | 2/2017 | |
| WO | WO-2021094257 | A1 * | 5/2021 | F21K 9/232 |

* cited by examiner

LED FILAMENT ARRANGEMENT WITH HEAT SINK STRUCTURE

CROSS-REFERENCE TO PRIOR APPLICATIONS

This application is the U.S. National Phase application under 35 U.S.C. § 371 of International Application No. PCT/EP2019/078518, filed on Oct. 21, 2019, which claims the benefit of European Patent Application No. 18203060.1, filed on Oct. 29, 2018. These applications are hereby incorporated by reference herein.

FIELD OF THE INVENTION

The present invention generally relates to lighting arrangements comprising one or more light emitting diodes. More specifically, the present invention is related to a light emitting diode (LED) filament arrangement with a heat sink structure.

BACKGROUND OF THE INVENTION

The use of light emitting diodes (LED) for illumination purposes continues to attract attention. Compared to incandescent lamps, fluorescent lamps, neon tube lamps, etc., LEDs provide numerous advantages such as a longer operational life, a reduced power consumption, and an increased efficiency related to the ratio between light energy and heat energy. In particular, LED filament lamps are highly appreciated as they are very decorative.

In addition to provide a maximum output of the light and/or a specific colour of the light from the LED filament lamps, the design or construction of a lighting device needs to take into account the evacuation of heat generated by the LED filaments. It should be noted that the effect of heat may be detrimental to the LED filaments, and their operation may hereby become erratic and unstable. Hence, thermal management is an important issue to prevent thermal damage of the LED filaments, and it is necessary to dissipate excess heat in order to maintain the reliability of the lighting device and to prevent premature failure of the LED filaments.

However, the current thermal management of LED arrangements may often be inefficient, and may be insufficient in case relatively high lumen outputs from the LED arrangements are desired.

Hence, it is an object of the present invention to try to overcome at least some of the deficiencies of present LED arrangements regarding their insufficient and/or inefficient heat dissipation properties, and to provide a LED arrangement with an improved thermal management.

SUMMARY OF THE INVENTION

Hence, it is of interest to overcome at least some of the deficiencies of the current thermal management of LED arrangements, e.g. comprising LED filaments, for an improved operation of these LED arrangements.

A LED filament is providing LED filament light and comprises a plurality of light emitting diodes (LEDs) arranged in a linear array. Preferably, the LED filament has a length L and a width W, wherein L>5 W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

This and other objects are achieved by providing a LED filament arrangement having the features in the independent claim. Preferred embodiments are defined in the dependent claims.

Hence, according to the present invention, there is provided a light emitting diode, LED, filament arrangement. The LED filament arrangement comprises at least one LED filament extending along a longitudinal axis, wherein the at least one LED filament comprises an array of a plurality of light emitting diodes, LEDs. The at least one LED filament comprises an encapsulant comprising a translucent material, wherein the encapsulant at least partially encloses the plurality of LEDs. The LED filament arrangement further comprises a heat sink structure, comprising an elongated thermally conducting element extending in the direction of the longitudinal axis A, wherein the encapsulant of the least one LED filament is in direct physical contact with the heat sink structure 150 over the entire length of the LED filament, forming a thermal connection with the heat sink structure for a dissipation of heat from the at least one LED filament. The heat sink structure comprises a reflective surface for reflecting the incident light from the at least one LED filament.

Thus, the present invention is based on the idea of providing a LED filament arrangement wherein heat may be conveniently and efficiently dissipated from the LED filament(s) during operation, whilst minimizing any obstruction of the light emitted from the LED filament arrangement. Hence, the present invention may provide the combination of a desired light distribution from the LED filament(s) during operation, while at the same time optimizing the thermal management of the LED filament arrangement via the heat sink structure.

In the present invention the heat sink structure may be a heat conducting element, like for instance a metal strip, on which the LED filament is connected such that it forms a thermal connection between the heat sink structure and the encapsulant of the LED filament, preferably over the entire length of the filament. Preferably, each filament is provided with a separate heat sink element.

The present invention is advantageous in that the thermal connection between the encapsulant of the LED filament(s) and the heat sink structure, e.g. by direct physical contact, ensures an efficient transfer of heat from the LED filament(s) to the heat sink structure by conduction. Consequently, the present invention provides an efficient thermal management of the LED arrangement, thereby minimizing the detrimental effects of heat on the LEDs of the LED filament(s) during operation.

The present invention is further advantageous in that the omnidirectional light output from the LED filament(s) is maintained to a relatively large degree in the LED filament arrangement, as the reflective heat sink structure is configured to efficiently reflect the incident light from the LEDs of the LED filament(s).

It will be appreciated that the LED filament arrangement of the present invention furthermore comprises relatively few components. The relatively low number of components is advantageous in that the LED filament arrangement is relatively inexpensive to fabricate. Moreover, the relatively low number of components of the LED filament arrangement implies an easier recycling, especially compared to devices or arrangements comprising a relatively high number of components which impede an easy disassembling and/or recycling operation.

The LED filament arrangement comprises at least one LED filament. The at least one LED filament, in its turn, comprises an array of LEDs. By the term "array", it is here meant a linear arrangement or chain of LEDs, or the like, arranged on the LED filament(s). The LED filament(s) further comprises an encapsulant comprising a translucent material, wherein the encapsulant at least partially encloses the plurality of LEDs. By the term "encapsulant", it is here meant a material, element, arrangement, or the like, which is configured or arranged to surround, encapsulate and/or enclose the plurality of LEDs of the LED filament(s). By the term "translucent material", it is here meant a material, composition and/or substance which is translucent and/or transparent for visible light. The LED filament arrangement further comprises a heat sink structure. By the term "heat sink structure", it is here meant substantially any structure, component, arrangement, or the like, which is configured and/or arranged to dissipate heat. The heat sink structure comprises a reflective surface for reflecting the incident light from the at least one LED filament. By "reflective surface", it is here meant a surface which is configured, suitable and/or arranged for reflecting incident light.

According to an embodiment of the present invention, the heat sink structure may comprise a reflective coating. By "reflective coating", it is here meant a coating or layer which is configured to reflect incident light. For example, a coating or layer of high reflectivity such as aluminum (Al) and/or silver (Ag) may be evaporated on the heat sink structure. The present embodiment is advantageous in that the reflective coating of the heat sink structure may efficiently reflect the light emitted from the LED filament(s) upon operation of the LED filament arrangement.

According to an embodiment of the present invention, the encapsulant of the at least one LED filament may be arranged in direct physical contact with the heat sink structure. In other words, the thermal connection between the encapsulant and the heat sink structure may be embodied by the encapsulant and the heat sink structure being in direct physical contact with each other. The present embodiment is advantageous in that the direct physical contact of the encapsulant of the at least one LED filament and the heat sink structure ensures an efficient transfer of heat from the LED filament(s) to the heat sink structure during operation of the LED arrangement. Consequently, the operating conditions of the LED arrangement in terms of thermal management may be improved to an even further extent.

According to an embodiment of the present invention, the encapsulant of the at least one LED filament may be glued to the heat sink structure. The present embodiment is advantageous in that the glue may ensure the fastening of the encapsulant to the heat sink structure. Furthermore, the heat dissipation from the encapsulant to the heat sink structure may be even further improved, e.g. by providing a glue which may comprise heat conductive particles.

According to an embodiment of the present invention, the LED filament may further comprise a clamp for pressing the encapsulant of the at least one LED filament to the heat sink structure. By "clamp", it is here meant substantially any device for clamping and/or pressing the encapsulant of the at least one LED filament to the heat sink structure. The present embodiment is advantageous in that the transfer of heat from the encapsulant of the at least one LED filament and the heat sink structure may be even more efficient. Consequently, the operating conditions of the LED arrangement in terms of thermal management may be improved to an even further extent. It will be appreciated that upon pressing the encapsulant of the LED filament to the heat sink structure, the encapsulant may be at least partially deformed. This deformation may increase the contact area between the encapsulant and the heat sink structure, and thereby improving the heat-dissipating effect even further.

According to an embodiment of the present invention, the LED filament arrangement may further comprise a translucent and heat-conductive substrate arranged between the encapsulant of the at least one LED filament and the heat sink structure. Due to the transparency and/or translucency of the substrate, the light emitted from the LED filament during operation may travel through the substrate, be reflected by the heat sink structure, and may again travel through the substrate upon this reflection. The present embodiment is advantageous in that the arrangement and/or properties of the substrate may influence the light distribution in a desired manner. For example, the choice of substrate material, the degree of transparency and/or translucency of the substrate, the refractive index of the substrate material, the color of the substrate, etc., may reproduce the light emitted from the LED filament in a desired manner. The present embodiment is further advantageous in that the substrate is heat-conductive (i.e. having a relatively high thermal conductivity), such that an efficient transfer of heat from the LED filament(s) and the heat sink structure during operation of the LED arrangement may be achieved. As a consequence of the heat dissipation accordingly performed by the heat sink structure, the operating conditions of the LED arrangement in terms of thermal management may be improved to an even further extent. In a preferred embodiment, the LED filament may comprise a transparent and heat-conductive substrate arranged between the encapsulant of the at least one LED filament and the heat sink structure. The embodiment is advantageous in that the transparency of the substrate provides less back reflection thus higher transmission, which improves the omnidirection lighting of the LED filament.

According to an embodiment of the present invention, the translucent and heat-conductive substrate may comprise a material selected from the group consisting of glass, sapphire, and quartz. Alternatively, a translucent ceramic material may be used as the translucent and heat-conductive substrate. In a preferred embodiment, the translucent and heat-conductive substrate is transparent. As the transparent substrate provides less back reflection, and thus higher transmission, the efficiency of the LED filament arrangement may be improved. For example, more light can escape and less light is (re) absorbed during operation of the LED filament arrangement. The embodiment also improves the beam shaping of the LED filament arrangement in case the translucent and heat-conductive substrate is shaped for performing beam shaping.

According to an embodiment of the present invention, the translucent and heat-conductive substrate may extend along the longitudinal axis, and may be longer than the at least one LED filament along the longitudinal axis. The present embodiment is advantageous in that the translucent and heat-conductive substrate may, to an even higher extent, ensure a desired light reproduction and/or heat transfer in the LED arrangement.

According to an embodiment of the present invention, the LED filament may further comprise a collimator arrangement configured to collimate the light emitted from the at least one LED filament. The present embodiment is advantageous in that the collimator arrangement may enable a homogeneous distribution and collimation of the light emitted from the LED filament arrangement during operation.

According to an embodiment of the present invention, the collimator arrangement may comprise the translucent and heat-conductive substrate of the previous embodiment, and wherein the translucent and heat-conductive substrate is configured to provide total internal reflection for the incident light from the at least one LED filament. In other words, the translucent and heat-conductive substrate may be integrated in the collimator arrangement, or even be the only element constituting the collimator arrangement, for collimating the light emitted from the at least one LED filament. Hence, the collimator arrangement may be the translucent and heat-conductive substrate. For optimal total internal reflection, the translucent and heat-conductive substrate may preferably be transparent. The present embodiment is advantageous in that the property of total internal reflection provided by the substrate may lead to an even smaller, simplified and/or cost-efficient LED filament arrangement.

According to an embodiment of the present invention, the collimator arrangement may comprise at least one reflector at least partially enclosing the at least one LED filament, and wherein the collimator arrangement, via the at least one reflector, is configured to collimate the light emitted from the at least one LED filament. The present embodiment is advantageous in that the provision of reflector(s) in the collimator arrangement of the LED filament arrangement is convenient for the purpose of collimation of light. For example, and according to an embodiment of the present invention, the at least one reflector may comprise at least one mirror for specular reflection of the light emitted from the at least one LED filament. Alternatively, or in combination with the arrangement of one or more mirrors, the at least one reflector may comprise a coating for diffuse reflection of the light emitted from the at least one LED filament according to yet another embodiment of the present invention.

According to an embodiment of the present invention, the plurality of LEDs of the at least one LED filament is configured to emit light from a respective surface of each LED of the plurality of LEDs, and wherein at least one LED of the plurality of LEDs is arranged in the at least one LED filament such that the respective surface of the at least one LED of the plurality of LEDs is facing the heat sink structure. In other words, the light-emitting surfaces of the plurality of LEDs may be arranged such that they face the heat sink structure of the LED filament arrangement. The present embodiment is advantageous in that indirect lighting is enabled by the LED filament arrangement, wherein the light is distributed and reflected by the heat sink structure and/or the translucent and heat-conductive substrate of the LED filament arrangement.

According to an embodiment of the present invention, the at least one LED filament may be configured to emit light omnidirectionally in the plane perpendicular to the longitudinal axis. By the term "omnidirectionally", it is here meant that the light from the LED filament(s) may be emitted in all directions. Hence, according to the embodiment, the light from the LED filament(s) may be emitted in a circumferential manner with respect to the arrangement of the LED filament(s) along the longitudinal axis. As the LED filament(s) of the LED filament arrangement may provide a distribution of light into (almost) all directions from the LED filament(s), the present embodiment is advantageous in that a desired and/or customized lighting may be achieved.

According to an embodiment of the present invention, there is provided a lighting device. The lighting device comprises a LED filament arrangement according to any one of the preceding embodiments. The lighting device further comprises a cover comprising an at least partially transparent material, wherein the cover at least partially encloses the LED filament arrangement. By "cover", it is here meant an enclosing element, such as a cap, cover, envelope, or the like, comprising an at least partial translucent and/or transparent material. Furthermore, the lighting device comprises an electrical connection connected to the LED filament arrangement for a supply of power to the plurality of LEDs of the LED filament arrangement. The present embodiment is advantageous in that the LED arrangement according to the invention may be conveniently arranged in substantially any lighting device, such as a LED filament lamp, luminaire, lighting system, or the like. The lighting device may further comprise a driver for supplying power the LEDs of the LED filament arrangement. Additionally, the lighting device may further comprise a controller for individual control of two or more subsets of LEDs of the LED filament arrangement, such as a first set of LEDs, a second set of LEDs, etc.

According to an embodiment of the present invention, the at least one LED filament may be arranged partly recessed in the heat sink structure. The obtained effect is improved thermal management. The reason is a larger contact area between the LED filament and the heat sink structure.

According to an embodiment of the present invention, the at least one LED filament may be arranged partly recessed in the translucent and heat-conductive substrate. The obtained effect is improved thermal management. The reason is a larger contact area between the LED filament and the translucent and heat-conductive substrate.

According to an embodiment of the present invention, the heat sink structure and the translucent and heat-conductive substrate may be shaped in a non-flat manner at the interface between the heat sink structure and the translucent and heat-conductive substrate. Preferably, the shape of the heat sink structure and the translucent and heat-conductive substrate is such that light of the LED filament which is emitted substantially perpendicular to the translucent and heat-conductive substrate is reflected by the heat sink in a direction away from the LED filament. The obtained effect is improved efficiency. The reason is that less light is trapped between the LED filament and the heat sink structure.

According to an embodiment of the present invention, the heat sink structure and/or the translucent and heat-conductive substrate may comprise structures at the interface between the heat sink structure and the translucent and heat-conductive substrate. Preferably, the structures in the heat sink and/or translucent and heat-conductive substrate are provided on a portion of the surface of the translucent and heat-conductive substrate. The portion is preferably located at a location underneath the LED filament. The obtained effect is improved efficiency. The reason is that less light is trapped between the LED filament and the heat sink structure, because light is redirected towards larger angles.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
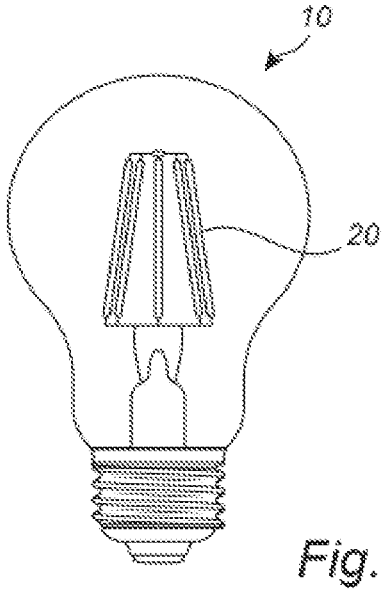
FIG. 1 schematically shows a LED filament lamp according to the prior art, comprising LED filaments, FIG. 2 schematically shows a LED filament of a LED filament arrangement according to an exemplifying embodiment of the present invention, and FIGS. 3-10 schematically show LED filament arrangements according to exemplifying embodiments of the present invention.

FIG. 1 shows a LED filament lamp 10 according to the prior art, comprising a plurality of LED filaments 20. LED filament lamps 10 of this kind are highly appreciated as they are very decorative, as well as providing numerous advantages compared to incandescent lamps such as a longer operational life, a reduced power consumption, and an increased efficiency related to the ratio between light energy and heat energy.

Figure 2:
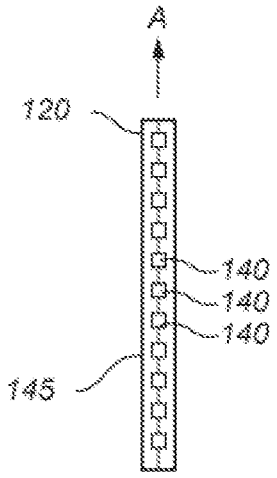
Fig. 2 Prior art

FIG. 2 schematically shows a LED filament 120, elongating along an axis A. The LED filament 120 may preferably have a length Lf in the range from 1 cm to 20 cm, more preferably 2 cm to 12 cm, and most preferred 3 cm to 10 cm. The LED filament 120 may preferably have a width Wf in the range from 0.5 mm to 10 mm, more preferably 0.8 mm to 8 mm, and most preferred 1 to 5 mm. The aspect ratio Lf/Wf is preferably at least 5, more preferably at least 8, and most preferred at least 10.

The LED filament 120 comprises an array or "chain" of LEDs 140 which is arranged on the LED filament 120. For example, the array or "chain" of LEDs 140 may comprise a plurality of adjacently arranged LEDs 140 wherein a respective wiring is provided between each pair of LEDs 140. The plurality of LEDs 140 preferably comprises more than 5 LEDs, more preferably more than 8 LEDs, and even more preferred more than 10 LEDs. The plurality of LEDs 140 may be direct emitting LEDs which provide a color. The LEDs 140 are preferably blue LEDs. The LEDs 140 may also be UV LEDs. A combination of LEDs 140, e.g. UV LEDs and blue light LEDs, may be used. The LEDs 140 may comprise laser diodes. The light emitted from the LED filament 120 during operation is preferably white light. The white light is preferably within 15 SDCM from the black body locus (BBL). The color temperature of the white light is preferably in the range of 2000 to 6000 K, more preferably in the range from 2100 to 5000 K, most preferably in the range from 2200 to 4000 K such as for example 2300 K or 2700 K. The white light has preferably a CRI of at least 75, more preferably at least 80, most preferably at least 85 such as for example 90 or 92.

The LED filament 120 further comprises an encapsulant 145 comprising a translucent material, wherein the encapsulant 145 at least partially encloses the plurality of LEDs 140. For example, and as indicated in FIG. 2, the encapsulant 145 fully encloses the plurality of LEDs 140. The encapsulant 145 may comprise a luminescent material, which is configured to emit light under external energy excitation. For example, the luminescent material may comprise a fluorescent material. The luminescent material may comprise an inorganic phosphor, and organic phosphor and/or quantum dots/rods. The UV/blue LED light may be partially or fully absorbed by the luminescent material and converted to light of another color e.g. green, yellow, orange and/or red.

Figure 3:
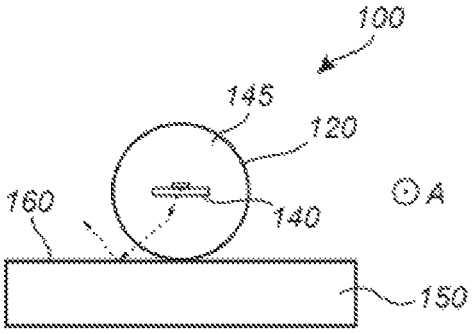

FIG. 3 shows a LED filament arrangement 100 according to an exemplifying embodiment of the present invention. It will be appreciated that the LED filament arrangement 100 may be provided in a LED filament lamp according to FIG. 1 or in substantially any other lighting device, arrangement or luminaire. The LED filament arrangement 100 comprises a LED filament 120, e.g. according to FIG. 2, extending along a longitudinal axis, A. It should be noted that there may be a plurality of LED filaments, whereas only one LED filament 120 is shown in FIG. 2 for an increased understanding. The LED filament 120 comprises an array of a plurality of light emitting diodes 140, LEDs. In FIG. 3, the LEDs 140 are arranged along the longitudinal axis, A, as shown in FIG. 2. The LED filament 120 further comprises an encapsulant 145 comprising a translucent material, wherein the encapsulant 145 at least partially encloses the plurality of LEDs 140. Here, the cross-section of the encapsulant 145 perpendicular to the longitudinal axis A is circular, but it will be noted that the encapsulant 145 may have substantially any other shape of its cross-section. The LED filament 120 is configured to emit light omnidirectionally in the plane perpendicular to the longitudinal axis A.

The LED filament arrangement 100 further comprises a heat sink structure 150, arranged to dissipate heat from the LED filament 120 during operation. Here, the heat sink structure 150 is schematically shown as a layer, but it should be noted that the heat sink structure 150 may take on substantially any form. For example, the heat sink structure 150 may be provided with flanges, fins, or the like, for an even more efficient dissipation of heat. The material of the heat sink structure 150 is preferably a metal or alloy with a relatively high thermal conductivity, such as copper (Cu) or aluminium (Al). The thermal conductivity of the heat sink is preferably at least 200 W/mK, more preferably more than 250 W/mK, and most preferably more than 300 W/mK.

The encapsulant 145 of the LED filament 120 is in thermal connection with the heat sink structure 150 for a dissipation of heat from the LED filament 120. More specifically, as indicated in FIG. 3, the encapsulant 145 of the LED filament 120 is arranged in direct physical contact with the heat sink structure 150. For example, the encapsulant 145 of the LED filament 120 may be glued to the heat sink structure 150, whereby a silicone-based glue may preferably be used. The glue may furthermore comprise heat conductive particles. The glue may cover a portion of the LED filament 120, or may completely cover the LED filament 120. In case the LED filament 120 is glued to the heat sink structure 150, the heat sink structure 150 may comprise protrusions, holes and/or cavities such that the LED filament 120 becomes firmly attached to the heat sink structure 150. The direct physical contact between the encapsulant 145 and the heat sink structure 150 being provided over the entire length of the LED filament 120 along the longitudinal axis A. Additionally, the LED filament arrangement 100 may further comprise a clamp (not shown) for pressing the encapsulant 145 of the LED filament 120 to the heat sink structure 150.

The heat sink structure 150 of the LED filament arrangement 100 comprises a reflective surface 160 for reflecting the incident light from the LED filament 120 during operation. The reflective surface 160 may, for example, comprise a reflective coating. The reflective surface 160 is configured to reflect incident light, and may comprise a coating or layer of high reflectivity such as aluminum (Al) and/or silver (Ag) which is evaporated on the heat sink structure 150.

By the LED filament arrangement 100 in FIG. 3, heat may be conveniently and efficiently dissipated from the LED filament 120 during operation, whilst minimizing any obstruction of the light emitted from the LED filament arrangement. Hence, the LED arrangement 100 may provide the combination of a desired light distribution from the LED filament 120 during operation, while at the same time optimizing the thermal management of the LED filament arrangement 100 via the heat sink structure 150.

Figure 4:
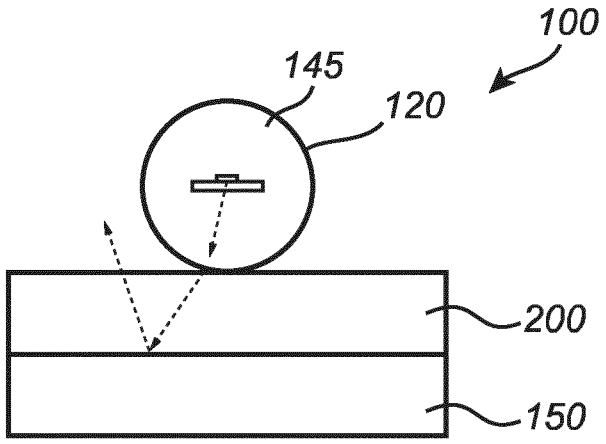

FIG. 4 schematically shows a LED filament arrangement 100 according to an another exemplifying embodiment of the present invention. Here, the LED filament arrangement 100 comprises a translucent and heat-conductive substrate 200 which is arranged between the encapsulant 145 of the LED filament 120 and the heat sink structure 150. Compared to the length Lf of the LED filament 120, the length of the translucent and heat-conductive substrate 200 is preferably in the range of 1.1 Lf to 2 Lf, more preferably in the range of 1.1 Lf to 1.5 Lf, and most preferred in the range of 1.1 Lf to 1.3 Lf. The width of the translucent and heat-conductive substrate is preferably in the range of 2 Wf to 20 Wf, more preferably in the range of 2 Wf to 12 Wf, and most preferred in the range of 2 Wf to 10 Wf. The translucent and heat-conductive substrate 200 may be glued to the heat sink structure 150. The translucent and heat-conductive substrate 200 may, for example, comprise glass, sapphire, and/or quartz. Due to the transparency and/or translucency of the substrate 200, the light emitted from the LED filament during operation may travel through the substrate 200, be reflected by the heat sink structure 150, and may again travel through the substrate 200 upon this reflection, as indicated in FIG. 4. Moreover, as the substrate 200 is heat-conductive (i.e. having a relatively high thermal conductivity), the substrate 200 efficiently transfers heat from the LED filament 120 to the heat sink structure 150 during operation of the LED arrangement 100. It will be appreciated that the translucent and heat-conductive substrate 200, which extends along the longitudinal axis A, may be longer than the LED filament 120.

Figure 5:
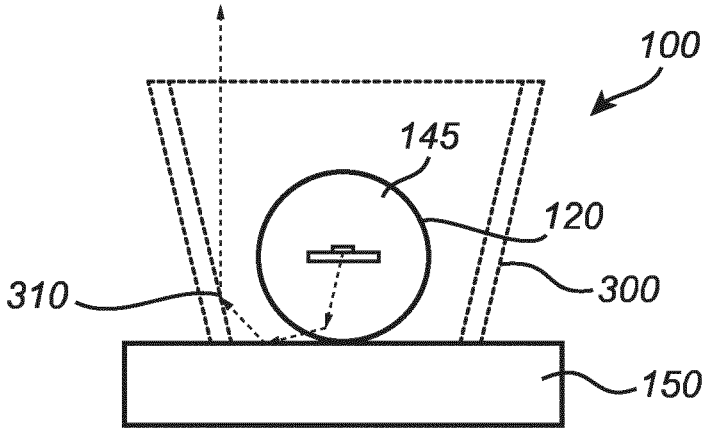

FIG. 5 schematically shows a LED filament arrangement 100 according to an another exemplifying embodiment of the present invention. The LED filament arrangement 100 comprises a LED filament arrangement according to FIG. 3 or FIG. 4, and further comprises a collimator arrangement 300 which is configured to collimate the light emitted from the LED filament 120. The collimator arrangement 300 comprises a schematically indicated reflector 310, which has the form of a lamp shade in this exemplifying embodiment. For example, the reflector 310 may be cup-shaped, i.e. constitute a parabolic reflector. The reflector 300, which is arranged on the heat sink 150, at least partially encloses the LED filament 120. Via the reflector 310, the collimator arrangement 300 is configured to collimate the light emitted from the LED filament 120 for enabling homogeneous light distribution from the LED filament arrangement 100. Hence, upon operation of the LED filament arrangement 100, light emitted from the LED filament 120 may be reflected by the heat sink structure 150, and be reflected by the collimator arrangement 300. The reflector 310 may comprise one or more mirrors for specular reflection of the light emitted from the LED filament 120. The reflectivity of the at least one reflector may, for example, be at least 80%, more preferred 85%, and even more preferred at least 90%. Furthermore, the reflectivity may be constant over the total visible spectrum of the light. Alternatively, or in combination with the mirror(s) for specular reflection of the light emitted from the LED filament 120, the reflector 310 may comprise a coating for diffuse reflection of the light emitted from the LED filament 120. For example, the coating may comprise particles of $TiO_2$, $BaSO_4$ and/or $Al_2O_3$. Alternatively, or in combination, the reflector 310 may comprise at least one surface which has been treated for diffuse reflection of the light emitted from the LED filament 120. Although not shown in FIG. 5, it should be noted that the LED filament arrangement 100 may further comprise a translucent and heat-conductive substrate according to one or more previously described embodiments.

Figure 6:
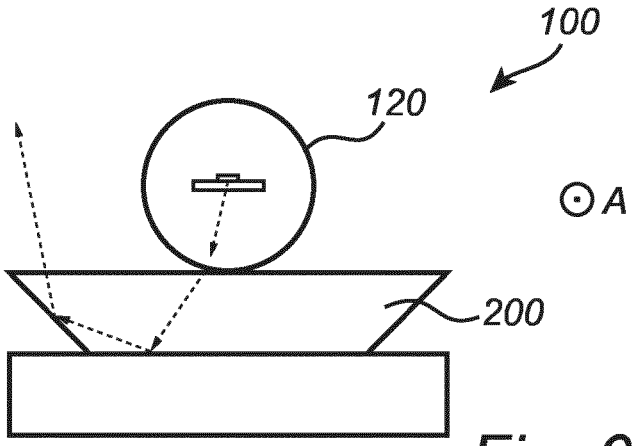

FIG. 6 schematically shows a LED filament arrangement 100 according to an another exemplifying embodiment of the present invention. Here, the collimator arrangement 300 comprises the translucent and heat-conductive substrate 200 which is configured to collimate the light emitted from the LED filament 120. More specifically, the translucent and heat-conductive substrate 200 is configured to provide total internal reflection (TIR) of the incident light from the LED filament 120. In a cross section of the translucent and heat-conductive substrate 200, perpendicular to the longitudinal axis A, a base portion of the translucent and heat-conductive substrate 200 is more narrow than a top portion of the translucent and heat-conductive substrate 200. This geometry allows a total internal reflection of the incident light from the LED filament 120 as indicated in FIG. 6.

Figure 7:
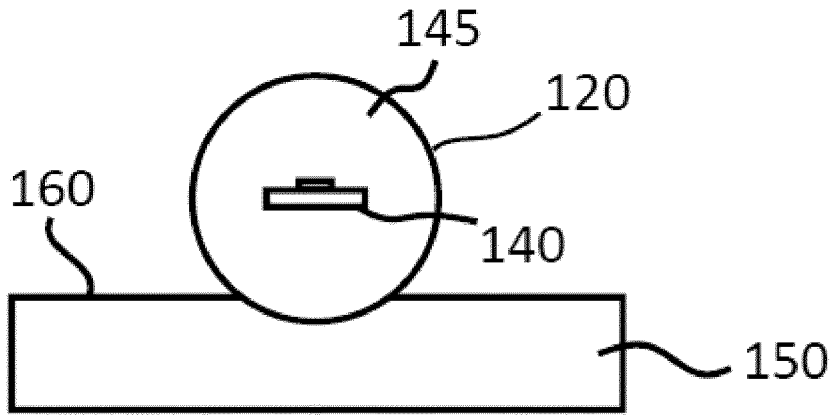

FIG. 7 schematically shows a LED filament arrangement 100 according to another exemplifying embodiment of the present invention. The at least one LED filament 120 may be arranged partly recessed in the heat sink structure 150.

Figure 8:
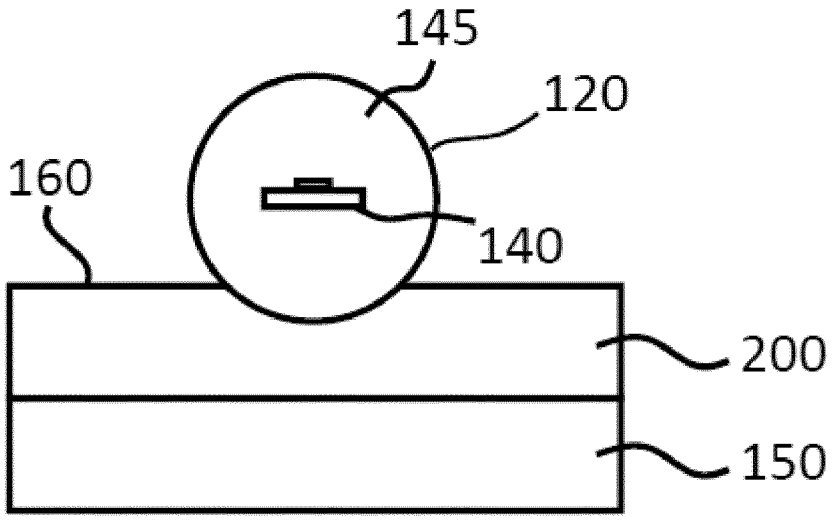

FIG. 8 schematically shows a LED filament arrangement 100 according to another exemplifying embodiment of the present invention. The at least one LED filament 120 may be arranged partly recessed in the translucent and heat-conductive substrate 200.

Figure 9:
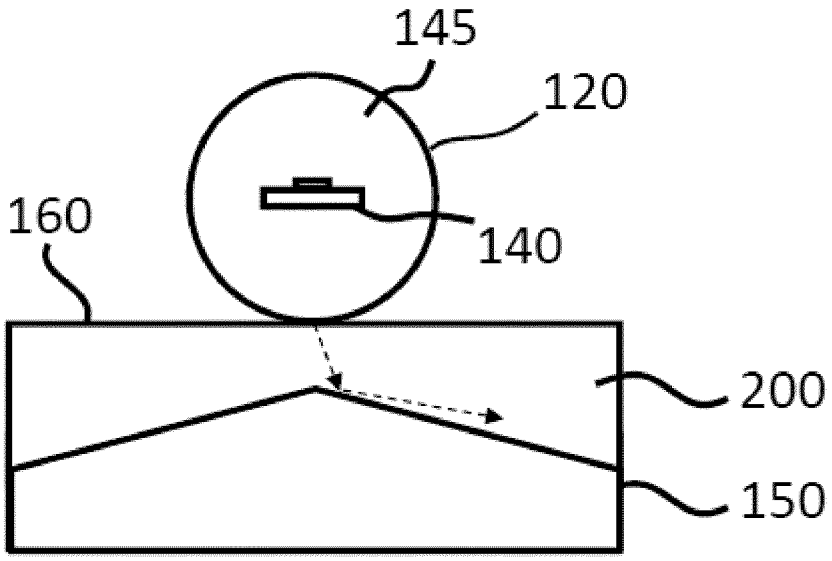

FIG. 9 schematically shows a LED filament arrangement 100 according to another exemplifying embodiment of the present invention. The heat sink structure 150 and the translucent and heat-conductive substrate 200 may be shaped in a non-flat manner at the interface I between the heat sink structure 150 and the translucent and heat-conductive substrate 200. Preferably, the shape of the heat sink structure 150 and the translucent and heat-conductive substrate 200 is such that light of the LED filament 120 which is emitted substantially perpendicular to the translucent and heat-conductive substrate 200 is reflected by the heat sink 150 in a direction away from the LED filament 120.

Figure 10:
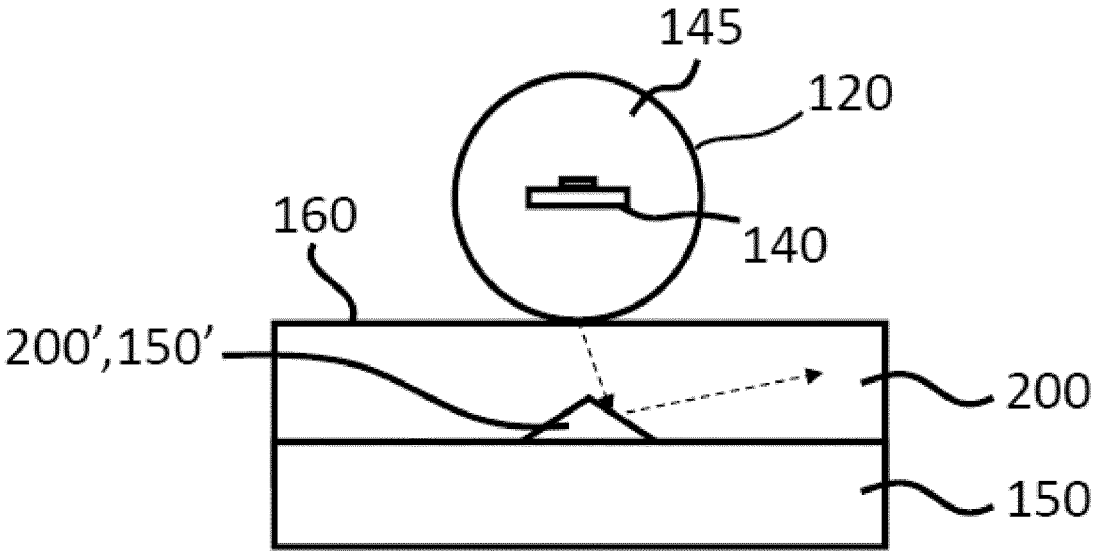

FIG. 10 schematically shows a LED filament arrangement 100 according to another exemplifying embodiment of the present invention. The heat sink structure 150 and/or the translucent and heat-conductive substrate 200 may comprise structures at the interface between the heat sink structure 150 and the translucent and heat-conductive substrate 200. For example it comprise refractive, diffractive or scattering structures.

The person skilled in the art realizes that the present invention by no means is limited to the preferred embodiments described above. On the contrary, many modifications and variations are possible within the scope of the appended claims. For example, one or more of the LED filament(s) 120, the heat sink structure 150, the reflector 300, etc., may have different shapes, dimensions and/or sizes than those depicted/described.

The invention claimed is:

1. A light emitting diode, LED, filament arrangement, comprising at least one LED filament extending along a longitudinal axis, A, wherein the at least one LED filament comprises:

an array of a plurality of light emitting diodes, LEDs, and an encapsulant comprising a translucent material, wherein the encapsulant at least partially encloses the plurality of LEDs, and a heat sink structure, comprising an elongated thermally conducting element extending in the direction of the longitudinal axis A, said at least one LED filament being connected to the elongated thermally conducting element wherein the encapsulant of the at least one LED filament is forming a thermal connection between the heat sink structure and the LED filament for a dissipation of heat from the at least one LED filament, and wherein the heat sink structure comprises a reflective surface for reflecting the incident light from the at least one LED filament, and wherein the LED filament arrangement is comprising a clamp for pressing the encapsulant of the at least one LED filament to the heat sink structure.

2. The LED filament arrangement according to claim 1, wherein the heat sink structure comprises a reflective coating.

3. The LED filament arrangement according to claim 1, wherein the encapsulant of the at least one LED filament is glued to the heat sink structure.

4. The LED filament arrangement according to claim 1, further comprising a translucent and heat-conductive substrate arranged between the encapsulant of the at least one LED filament and the heat sink structure.

5. The LED filament arrangement according to claim 4, wherein the translucent and heat-conductive substrate comprises a material selected from the group consisting of glass, sapphire, quartz.

6. The LED filament arrangement according to claim 4, wherein the translucent and heat-conductive substrate extends along the longitudinal axis, and is longer than the at least one LED filament along the longitudinal axis.

7. The LED filament arrangement according to claim 6, wherein the collimator arrangement comprises the translucent and heat-conductive substrate, and wherein the translucent and heat-conductive substrate is configured to provide total internal reflection for the incident light from the at least one LED filament.

8. The LED filament arrangement according to claim 1, further comprising a collimator arrangement configured to collimate the light emitted from the at least one LED filament.

9. The LED filament arrangement according to claim 8, wherein the collimator arrangement comprises at least one reflector at least partially enclosing the at least one LED filament, and wherein the collimator arrangement, via the at least one reflector, is configured to collimate the light emitted from the at least one LED filament.

10. The LED filament arrangement according to claim 9, wherein the at least one reflector comprises at least one mirror for specular reflection of the light emitted from the at least one LED filament.

11. The LED filament arrangement according to claim 1, wherein the plurality of LEDs of the at least one LED filament is configured to emit light from a respective surface of each LED of the plurality of LEDs, and wherein at least one LED of the plurality of LEDs is arranged in the at least one LED filament such that the respective surface of the at least one LED of the plurality of LEDs is facing the heat sink structure.

12. The LED filament arrangement according to claim 1, wherein the at least one LED filament is configured to emit light omnidirectionally in the plane perpendicular to the longitudinal axis.

13. Lighting device, comprising:

a LED filament arrangement according to claim 1, a cover comprising an at least partially transparent material, wherein the cover at least partially encloses the LED filament arrangement, and an electrical connection connected to the LED filament arrangement for a supply of power to the plurality of LEDs of the LED filament arrangement.

* * * * *